US007143671B1

(12) United States Patent
Lai

(10) Patent No.: US 7,143,671 B1
(45) Date of Patent: Dec. 5, 2006

(54) LEVER-WRENCH PLIERS

(76) Inventor: Chiu-Wen Lai, P.O. Box 36-80, Taichung City (TW)

( * ) Notice: Subject to any disclaimer, the term of this patent is extended or adjusted under 35 U.S.C. 154(b) by 7 days.

(21) Appl. No.: 11/181,245

(22) Filed: Jul. 14, 2005

(51) Int. Cl.
*B25B 7/12* (2006.01)
*B25B 7/02* (2006.01)

(52) U.S. Cl. ..... 81/368; 81/418

(58) Field of Classification Search ..... 81/368, 81/370, 418, 419, 420, 424.5, 186, 9.3
See application file for complete search history.

(56) References Cited

U.S. PATENT DOCUMENTS 1,386,136 A * 8/1921 Sibbald ..... 81/107
2,173,215 A * 9/1939 Shover ..... 81/423
2,534,985 A * 12/1950 Napier ..... 81/126
2,584,353 A * 2/1952 Keiser ..... 81/347
2,953,050 A * 9/1960 Nolen ..... 81/99
6,311,586 B1 * 11/2001 Hirse ..... 81/99

* cited by examiner

*Primary Examiner*—David B. Thomas
(74) *Attorney, Agent, or Firm*—Charles E. Baxley

(57) ABSTRACT

Disclosed is a lever-wrench pliers, which includes a fixed jaw tip that define a mouth and has three clamping faces around the mouth, and a movable jaw that has a jaw tip with a toothed clamping face facing the middle one of the three clamping faces of the fixed jaw tip.

7 Claims, 9 Drawing Sheets

LEVER-WRENCH PLIERS

BACKGROUND OF THE INVENTION

1. Field of the Invention

The present invention relates hand tools and more particularly, to an improved structure of pliers.

2. Description of the Related Art

A conventional lever-wrench pliers, as shown in FIG. 1, comprises a body 1, a movable jaw 2 pivoted to the body 1, a lever 3 pivoted to the movable jaw 2, a toggle lever 4, which has one end (the fixed end) pivoted to the lever 3 and the other end (the free end) inserted into the inside of the body 1, an adjusting screw 5 threaded into the bottom side of the body 1 and stopped against the free end of the toggle lever 4, a spring 7 connected between the body 1 and the movable jaw 2 to hold the movable jaw 2 in the open position relative to the body 1, and a release lever 6 pivoted to the lever 3 to support the toggle lever 4. Moving the lever 3 relative to the body 1 controls closing/opening of the movable jaw 3 relative to the body 1. Rotating the adjusting screw 5 forwards/backwards relative to the body 1 adjusts the moving distance of the toggle lever 4 and the lever 3 so as to further adjust the opening extent between the movable jaw 2 and the body 1 subject to the workpiece 8 to be locked.

When pressing the release lever 6, the toggle lever 4 is lifted to bias the lever 3 relative to the toggle lever 4, and therefore the movable jaw 2 is turned outwards from the body 1 to release the workpiece 8.

This design of lever-wrench pliers holds the workpiece 8 by clamping the workpiece from two opposite sides. When holding the workpiece 8, the user must apply much force to the body 1 and the lever 3. Further, because the teeth of the jaw tip of the body 1 and the teeth of the movable jaw 2 are respectively formed on a respective flat surface, the lever-wrench pliers may slip from the workpiece 8 during operation.

Therefore, it is desirable to provide a lever-wrench pliers that eliminates the aforesaid drawbacks.

SUMMARY OF THE INVENTION

The present invention has been accomplished under the circumstances in view. It is one object of the present invention to provide a lever-wrench pliers, which can be operated with less effort to grasp the workpiece positively. It is another object of the present invention to provide a lever-wrench pliers, which does not slip from the workpiece during the operation.

To achieve these and other objects of the present invention, the lever-wrench pliers comprises a body, the body having a first end and a second end; a fixed jaw tip fixedly provided at the first end of the body; an adjusting screw axially threaded into the second end of the body and forwardly backwardly rotatable relative to the body; a movable jaw pivotally connected to the body corresponding to the fixed jaw tip; a main lever, the main lever having a first end pivotally connected to the movable jaw and a second end terminating in a grip; a toggle lever, the toggle lever having a first end pivotally connected to the main lever and a second end inserted into the body and supported on one end of the adjusting screw; a spring member connected between the movable jaw and the body to force the movable jaw outwards from the body; and a release lever, the release lever having a middle part pivotally connected to the main lever, a first end stoppable against the toggle lever and a second end extending out of the main lever for operation by the user; wherein the fixed jaw tip defines a mouth, having a first clamping face facing one lateral side of the mouth, a second clamping face extending outwards from a top side of the first clamping face and facing a top side of the mouth, and a third clamping face extending obliquely downwards from a bottom side of the first clamping face and facing a lower side of the mouth; the movable jaw has a jaw tip extending toward the mouth, the jaw tip of the movable jaw having a toothed clamping face facing the first clamping face.

According to an alternate form of the present invention, the movable jaw is pivotally connected to the body through a slip joint so that the lever-wrench pliers can be used for turning the workpiece with a socket or tool member in one single direction.

DETAILED DESCRIPTION OF THE INVENTION

Figure 1:
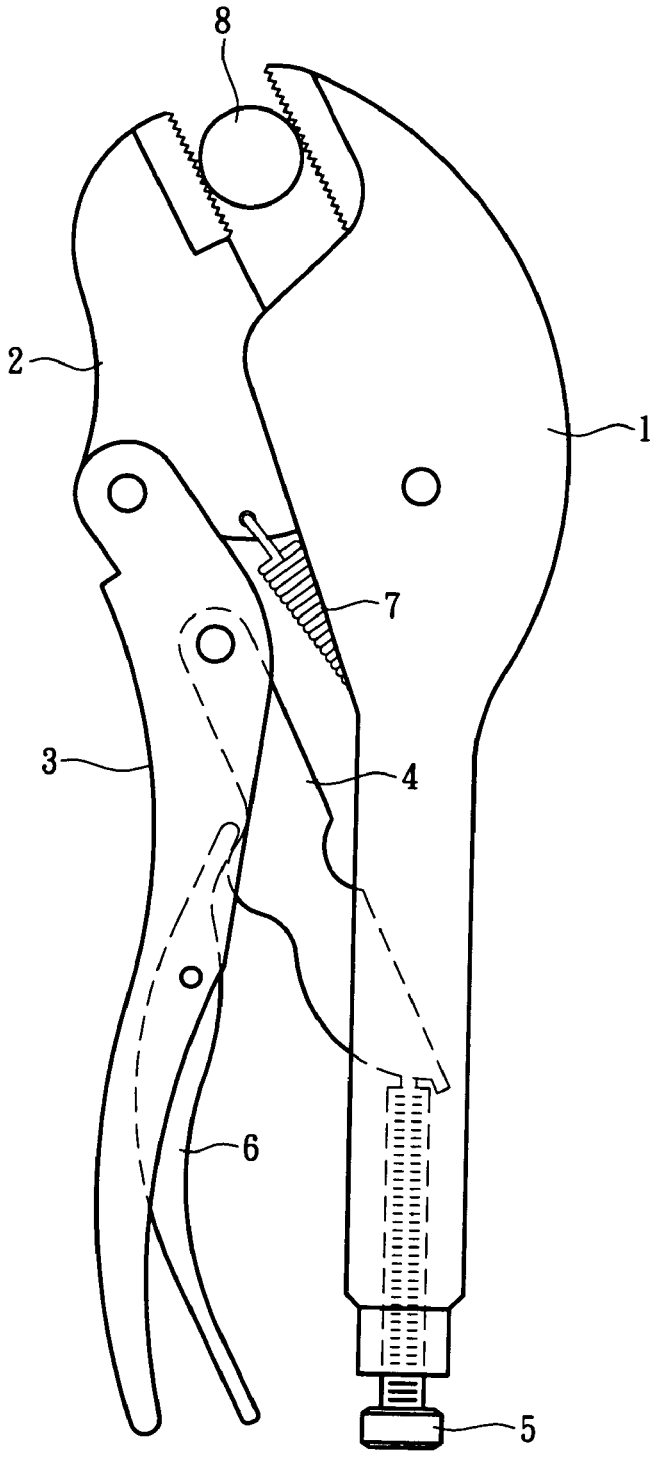
FIG. 1 PRIOR ART
FIG. 1 is a plain view of a lever-wrench pliers according to the prior art.
Figure 2:
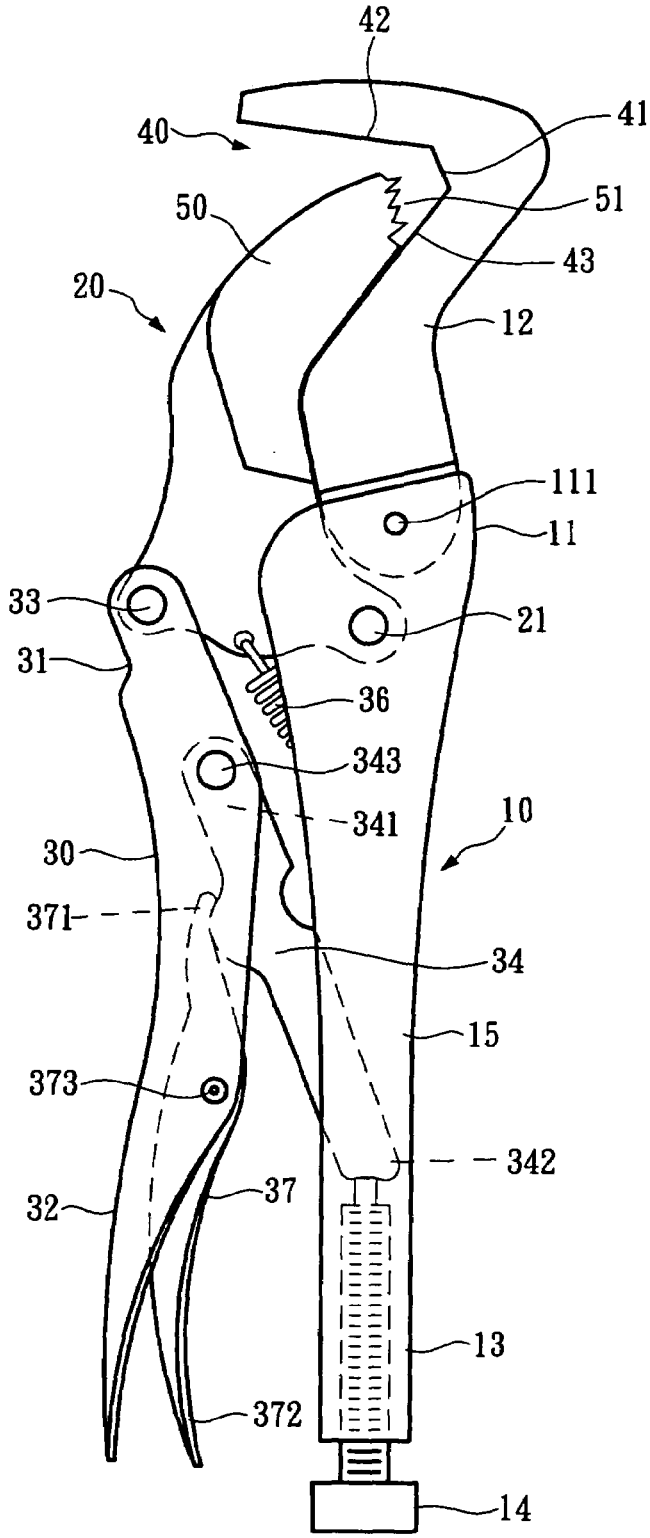
FIG. 2 is an elevational assembly view of the combination cabinet according to the present invention.
Figure 3:
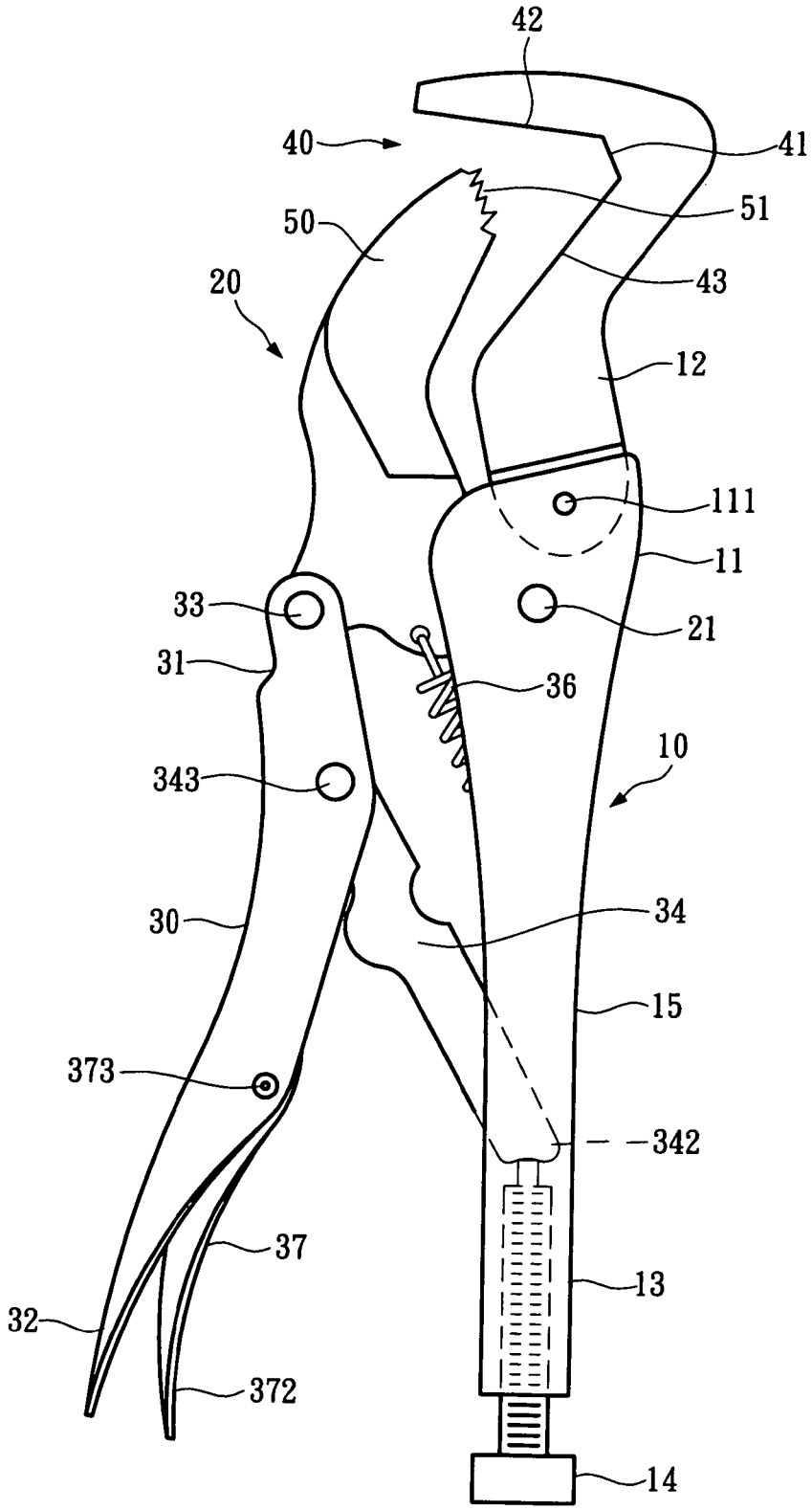
FIG. 3 is a plain view showing the closed status of a lever-wrench pliers according to the present invention.

Referring to FIGS. 2 and 3, a lever-wrench pliers in accordance with the present invention is shown comprising:

a body 10, which has a first end 11, a second end 13, and a hollow grip 15 connected between the first end 11 and the second end 13;

a jaw tip 12 affixed to the first end 11 of the body 10 with a fastener 111;

an adjusting screw 14 axially threaded into the second end 13 of the body 10;

a movable jaw 20 pivotally connected to the body 10 with a pivot 21 adjacent to the first end 11 and forwardly backwardly turnable relative to the jaw tip 12;

a lever 30, which has a first end 31 pivotally connected to the movable jaw 20 with a pivot 33 and a second end terminating in a grip 32;

a toggle lever 34, which has a first end 341 pivotally connected to the lever 30 with a pivot 343 and a second end 342 inserted into the hollow grip 15 of the body 10 and supported on the end of the adjusting screw 14;

a spring member 36 connected between the movable jaw 20 and the body 10 to force the movable jaw 20 apart from the jaw tip 12 of the body 10; and a release lever 37, which is pivotally connected with a middle part thereof to the lever 30 with a pivot 373, having a first end 371 stoppable against the toggle lever 34 and a second end 372 extending out of the grip 32 of the lever 30 for pressing by the user.

The jaw tip 12 defines a mouth 40, having a first clamping face 41 facing one lateral side of the mouth 40, a second clamping face 42 extending outwards from the top side of the first clamping face 41 and facing the top side of the mouth 40, and a third clamping face 43 extending obliquely downwards from the bottom side of the first clamping face 41 and facing the lower side of the mouth 40. The first clamping face 41 and the second clamping face 42 define a 120-degree contained angle. The second clamping face 42 and the third clamping face 43 define a 120-degree contained angle. The movable jaw 20 has a jaw tip 50 extending toward the mouth 40. The jaw tip 50 has a toothed clamping face 51 facing the first clamping face 41.

Referring to FIG. 2 again, when the lever-wrench pliers is closed, the toggle lever 34 is stopped against the first end of the release lever 37. At this time, the adjusting screw 14 is rotated forwards and stopped against the second end 342 of the toggle lever 34. At this time, the jaw tip 50 of the movable jaw 20 is received in the mouth 40.

Referring to FIG. 3, when wishing to open the lever-wrench pliers, rotating the adjusting screw 14 backwards to adjust the angular position of the toggle lever 34 relative to the lever 30, so as to set the size of the mouth 40 between the first clamping face 41 and the toothed clamping face 51.

Figure 4:
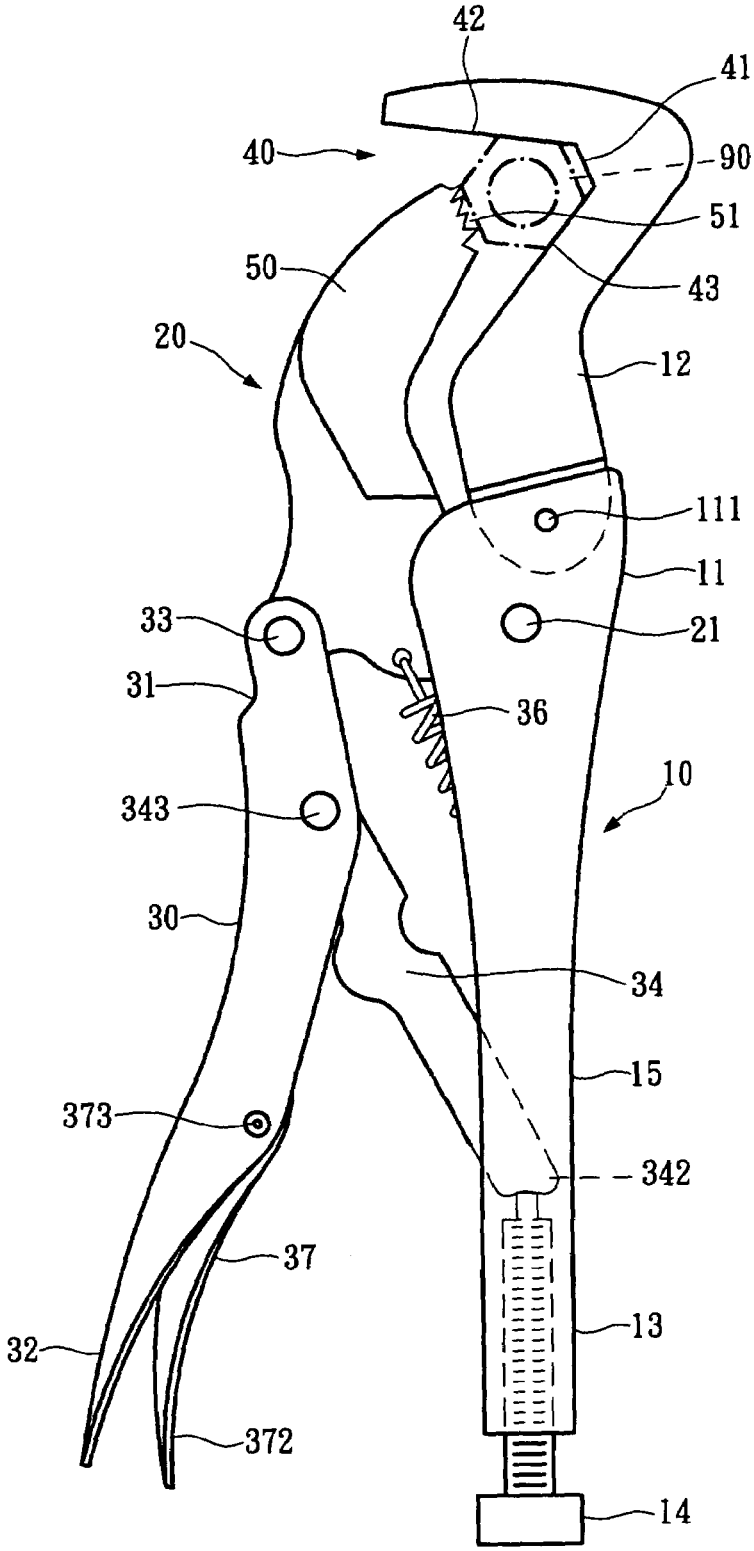
FIG. 4 is a schematic drawing showing the lever-wrench pliers grasped a hexagonal nut according to the present invention.

FIG. 4 shows the lever-wrench pliers grasped a hexagonal nut 90. As illustrated, the second clamping face 42 and third clamping face 43 are respectively clamped on two distal sides of the hexagonal nut 90, and the toothed clamping face 51 of the jaw tip 50 is clamped on the other distal side of the hexagonal nut 90, i.e., the lever-wrench pliers clamps the hexagonal nut 90 from three sides. Therefore, the user can grasp the hexagonal nut 90 with the lever-wrench pliers positively with less effort.

Figure 5:
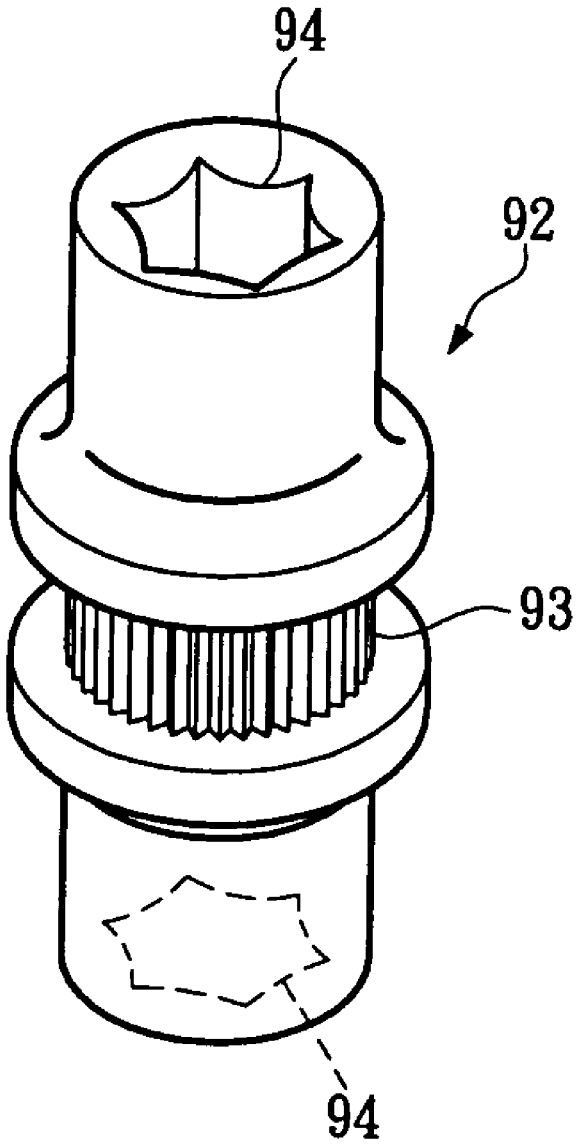
FIG. 5 is an elevational view of socket for use with the lever-wrench pliers according to the present invention.

The lever-wrench pliers of the present invention can be used with a specially designed socket 92 as shown in FIG. 5. The socket 92 has two coupling holes 94 respectively formed in the two distal ends, and a ratchet section 93 on the middle.

Figure 6:
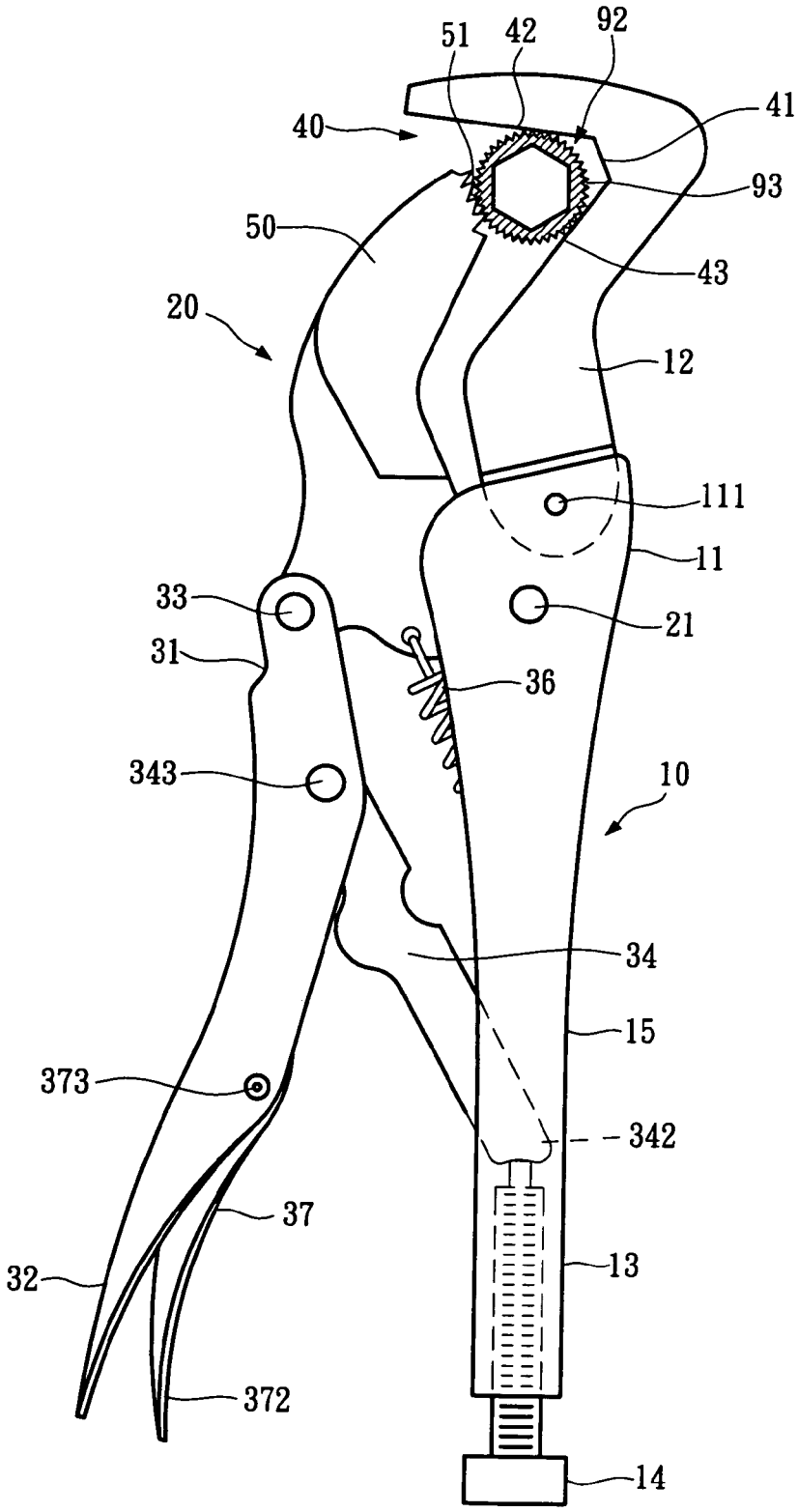
FIG. 6 is a schematic plain view showing the lever-wrench pliers grasped the socket according to the present invention.

Referring to FIG. 6, when grasped the socket 92 with the lever-wrench pliers, the second clamping face 42 and third clamping face 43 of the jaw tip 12 the toothed clamping face 51 of the jaw tip 50 are respectively clamped on the hexagonal nut 90 from three different sides, at this time the user can turn the hexagonal nut 90 with the lever-wrench pliers positively.

Figure 7:
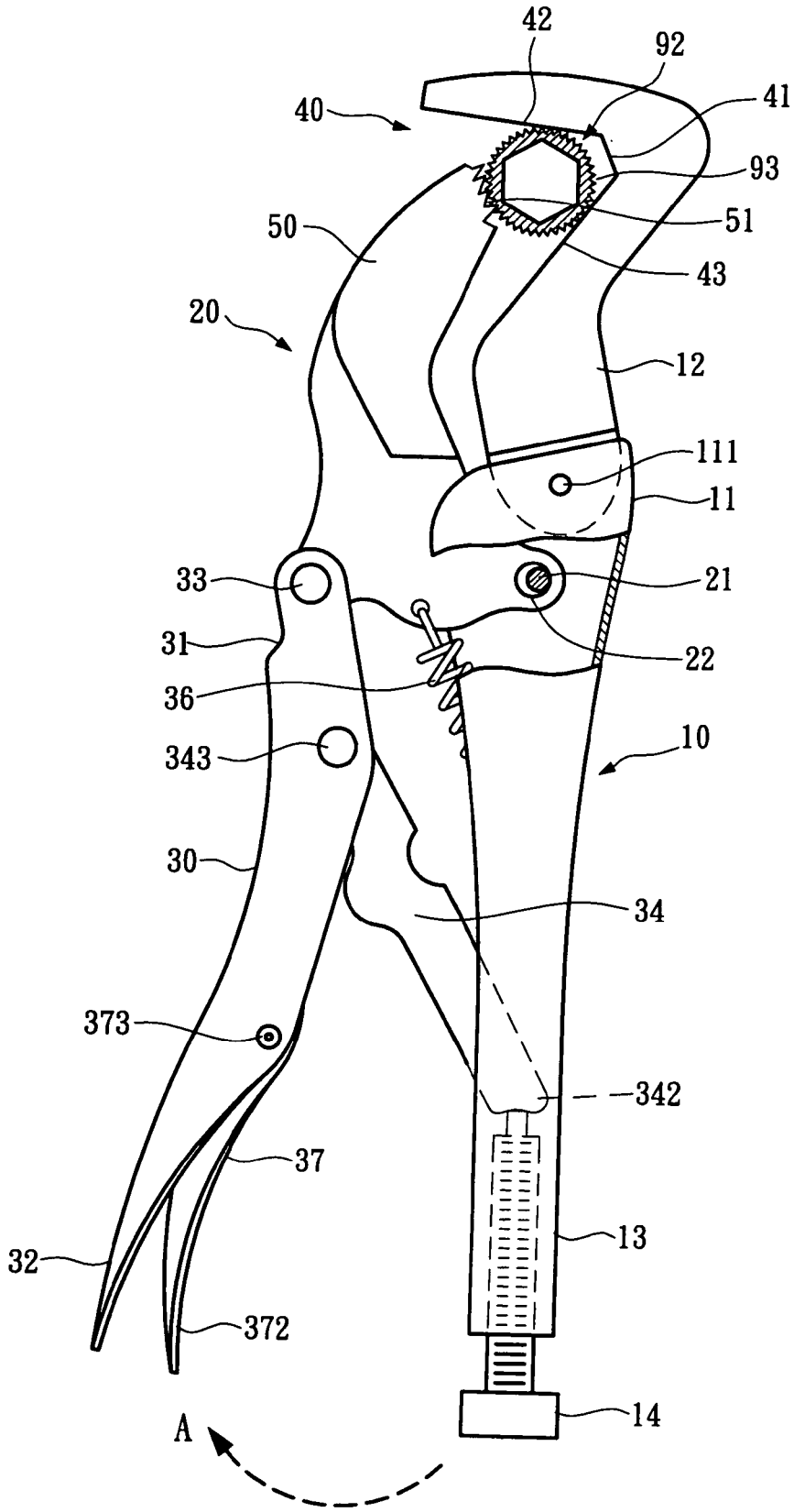
FIG. 7 is a schematic drawing showing the forward turning operation of an alternate form of the lever-wrench pliers according to the present invention.
Figure 8:
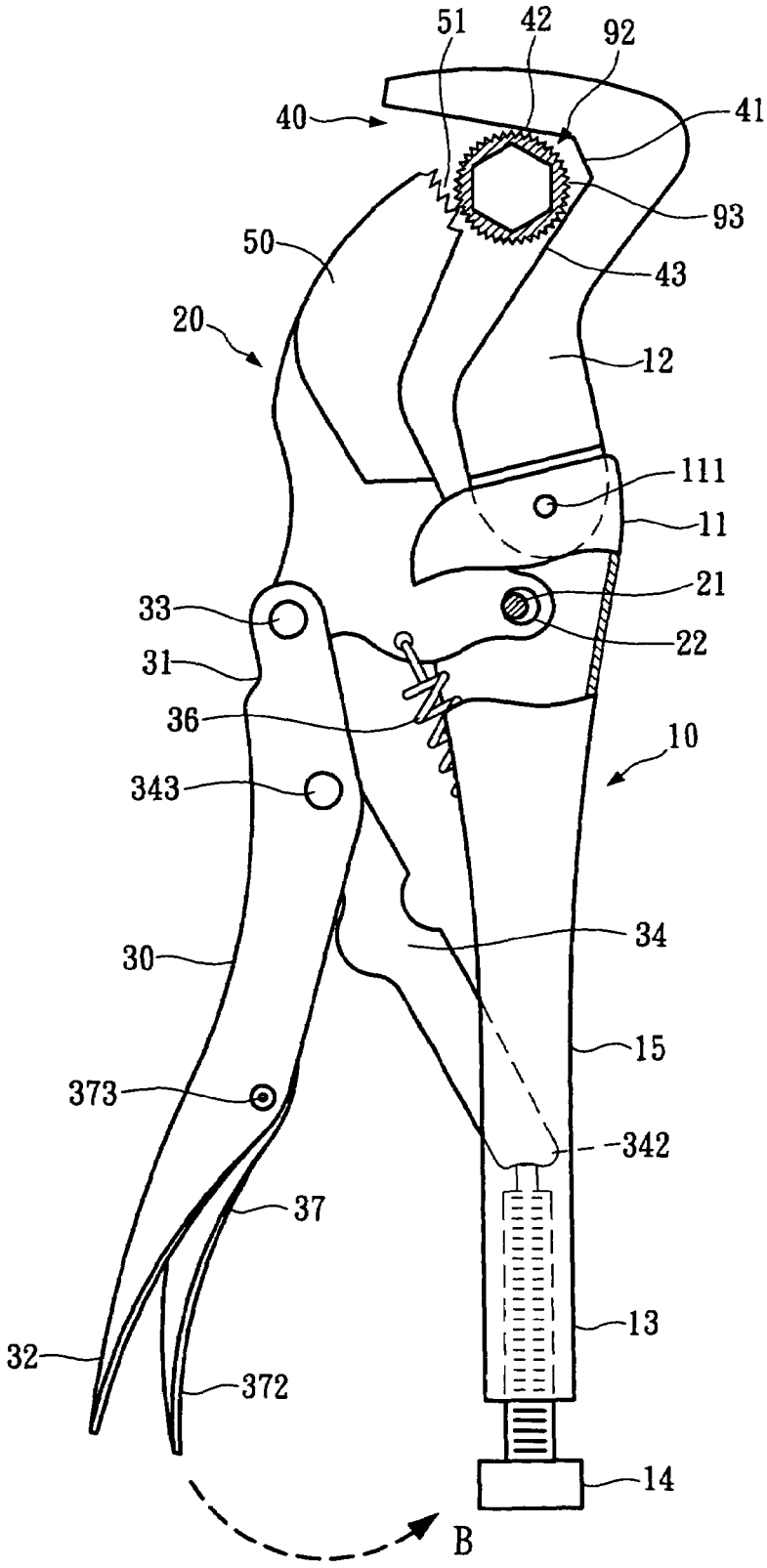
FIG. 8 corresponds to FIG. 7, showing the backward turning operation of the lever-wrench pliers.

The lever-wrench pliers can be so made that the jaw tips 12 and 50 can be controlled to rotate the socket 90 in one single direction, i.e., the movable jaw 20 is pivotally connected to the body 10 through a slip joint. As shown in FIG. 7, the movable jaw 20 has a through hole 22 that receives the pivot 21, which is fixedly fastened to the body 10. The diameter of the through hole 22 is greater than the pivot 21. When turning the lever-wrench pliers in direction A as shown in FIG. 7, the toothed clamping face 51 of the jaw tip 50 of the movable jaw 20 is forced against the ratchet section 93 of the socket 92 to push the socket 92 toward the second clamping face 42 and third clamping face 43 of the jaw tip 12, thereby causing the socket 90 to be turned with the lever-wrench pliers. On the contrary, when turning the lever-wrench pliers in the reversed direction B as shown in FIG. 8, the toothed clamping face 51 of the jaw tip 50 of the movable jaw 20 is released from the ratchet section 93 of the socket 90, and therefore the socket 90 is disengaged from the second clamping face 42 and third clamping face 43 of the jaw tip 12, i.e., the lever-wrench pliers runs idle in this direction.

Figure 9:
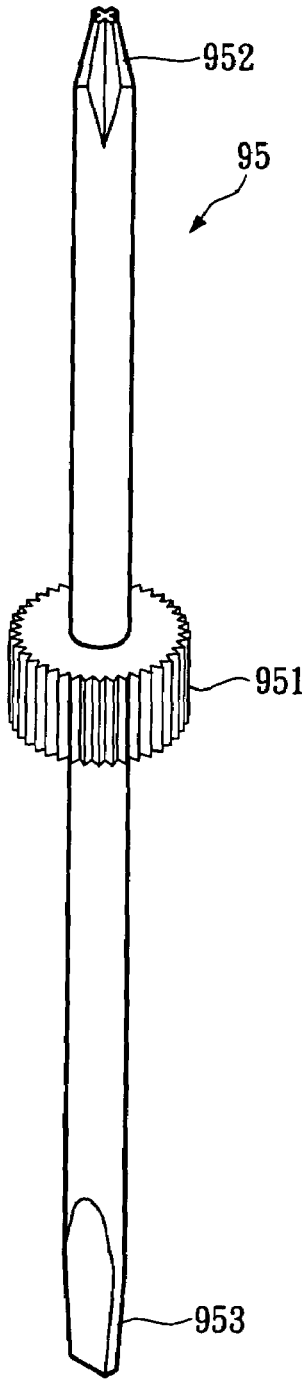
FIG. 9 is an elevational view of a tool member for use with the lever-wrench pliers according to the present invention.

FIG. 9 shows a tool member 95 for use with the lever-wrench pliers according to the present invention. As illustrated, the tool member 95 has a ratchet section 951 on the middle, a first tip, for example, a Phillips head tip 952 at one end, and a second tip, for example, a cabinet tip 953 at the other end. The tool member 95 can be used with the lever-wrench pliers in the same way as the use of the aforesaid socket 90.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lever-wrench pliers comprising:

a body, said body having a first end and a second end;

a fixed jaw tip fixedly provided at the first end of said body;

an adjusting screw axially threaded into the second end of said body and forwardly backwardly rotatable relative to said body;

a movable jaw pivotally connected to said body corresponding to said fixed jaw tip;

a main lever, said main lever having a first end pivotally connected to said movable jaw and a second end terminating in a grip;

a toggle lever, said toggle lever having a first end pivotally connected to said main lever and a second end inserted into said body and supported on one end of said adjusting screw;

a spring member connected between said movable jaw and said body to force said movable jaw outwards from said body; and a release lever, said release lever having a middle part pivotally connected to said main lever, a first end stoppable against said toggle lever and a second end extending out of said main lever for operation by the user;

wherein said fixed jaw tip defines a mouth, having a first clamping face facing one lateral side of said mouth, a second clamping face extending outwards from a top side of said first clamping face and facing a top side of said mouth, and a third clamping face extending obliquely downwards from a bottom side of said first clamping face and facing a lower side of said mouth; said movable jaw has a jaw tip extending toward said mouth, the jaw tip of said movable jaw having a toothed clamping face facing said first clamping face.

2. The lever-wrench pliers as claimed in claim 1, wherein said first clamping face and said second clamping face of said fixed jaw tip define a 120-degree contained angle.

3. The lever-wrench pliers as claimed in claim 1, wherein said second clamping face and said third clamping face define a 120-degree contained angle.

4. The lever-wrench pliers as claimed in claim 1, wherein said movable jaw is pivotally connected to said body through a slip joint.

5. A lever-wrench pliers comprising:

a body, said body having a first end and a second end;

a fixed jaw tip fixedly provided at the first end of said body;

an adjusting screw axially threaded into the second end of said body and forwardly backwardly rotatable relative to said body;

a movable jaw pivotally connected to said body corresponding to said fixed jaw tip;

a main lever, said main lever having a first end pivotally connected to said movable jaw and a second end terminating in a grip;

a toggle lever, said toggle lever having a first end pivotally connected to said main lever and a second end inserted into said body and supported on one end of said adjusting screw;

a spring member connected between said movable jaw and said body to force said movable jaw outwards from said body; and a release lever, said release lever having a middle part pivotally connected to said main lever, a first end stoppable against said toggle lever and a second end extending out of said main lever for operation by the user;

wherein said fixed jaw tip defines a mouth, having a first clamping face facing one lateral side of said mouth, a second clamping face extending outwards from a top side of said first clamping face and facing a top side of said mouth, and a third clamping face extending obliquely downwards from a bottom side of said first clamping face and facing a lower side of said mouth; said movable jaw is pivotally connected to said body through a slip joint, having a jaw tip extending toward said mouth, the jaw tip of said movable jaw having a toothed clamping face facing said first clamping face.

6. The lever-wrench pliers as claimed in claim 5, wherein said first clamping face and said second clamping face of said fixed jaw tip define a 120-degree contained angle.

7. The lever-wrench pliers as claimed in claim 5, wherein said second clamping face and said third clamping face define a 120-degree contained angle.

* * * * *